US008678014B2

(12) United States Patent
Tsuruizumi et al.

(10) Patent No.: US 8,678,014 B2
(45) Date of Patent: Mar. 25, 2014

(54) METHOD FOR DRYING MOLDED PRODUCT FOR NON-COMBUSTIBLE SMOKING ARTICLE

(75) Inventors: Ryutaro Tsuruizumi, Tokyo (JP); Manabu Takeuchi, Tokyo (JP); Manabu Yamada, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 74 days.

(21) Appl. No.: 12/910,398

(22) Filed: Oct. 22, 2010

(65) Prior Publication Data

US 2011/0030707 A1 Feb. 10, 2011

Related U.S. Application Data

(63) Continuation of application No. PCT/JP2009/057216, filed on Apr. 8, 2009.

(30) Foreign Application Priority Data

Apr. 25, 2008 (JP) ..... 2008-116020

(51) Int. Cl.
*A24F 11/00* (2006.01)
*A24F 47/00* (2006.01)

(52) U.S. Cl.
USPC ..... 131/328; 131/195; 131/369; 131/359

(58) Field of Classification Search
None
See application file for complete search history.

(56) References Cited

U.S. PATENT DOCUMENTS

| | | | | |
|---|---|---|---|---|
| 4,333,484 | A * | 6/1982 | Keritsis | 131/359 |
| 4,819,665 | A * | 4/1989 | Roberts et al. | 131/195 |
| 5,129,409 | A | 7/1992 | White et al. | |
| 5,469,871 | A | 11/1995 | Barnes et al. | |
| 5,560,376 | A | 10/1996 | Meiring et al. | |
| 5,706,834 | A * | 1/1998 | Meiring et al. | 131/369 |

FOREIGN PATENT DOCUMENTS

| | | | |
|---|---|---|---|
| JP | 3-39077 | A | 2/1991 |
| JP | 6-189733 | A | 7/1994 |
| JP | 8-332067 | A | 12/1996 |

OTHER PUBLICATIONS

International Preliminary Report on Patentability and Written Opinion mailed Dec. 23, 2010, in PCT International Application No. PCT/JP2009/057216.

* cited by examiner

*Primary Examiner* — Richard Crispino
*Assistant Examiner* — Phu Nguyen
(74) *Attorney, Agent, or Firm* — Birch, Stewart, Kolasch & Birch, LLP

(57) ABSTRACT

The present invention provides a method for drying a molded product for a non-combustible smoking article, including preparing a molded product for a non-combustible smoking article corresponding to two non-combustible smoking articles includes an aerosol generating section which generates aerosol when heated and carbonaceous heat sources fitted to both ends of the aerosol generating section, covering the aerosol generating section with a far infrared reflective cover, and irradiating the carbonaceous heat sources with far infrared radiation from a far infrared heater.

4 Claims, 2 Drawing Sheets

METHOD FOR DRYING MOLDED PRODUCT FOR NON-COMBUSTIBLE SMOKING ARTICLE

CROSS-REFERENCE TO RELATED APPLICATIONS

This is a Continuation Application of PCT Application No. PCT/JP2009/057216, filed Apr. 8, 2009, which was published under PCT Article 21(2) in Japanese.

This application is based upon and claims the benefit of priority from prior Japanese Patent Application No. 2008-116020, filed Apr. 25, 2008, the entire contents of which are incorporated herein by reference.

BACKGROUND OF THE INVENTION

1. Field of the Invention

The present invention relates to a method for drying a molded product for non-combustible smoking article and a drying apparatus.

2. Description of the Related Art

Non-combustible smoking articles instead of cigarettes have been developed for enjoying flavor and taste of tobacco or aerosol without combusting any tobacco leaf. The non-combustible smoking article comprises a heat source that is a heat generating member fitted to the tip thereof, and an aerosol generating section in which an aerosol generating material is contained in an appropriate substrate. The heat source and the aerosol generating material are physically separated from each other. In this type of smoking article, the heat source is combusted and the generated heat is used to heat the aerosol generating material in the aerosol generating section without combusting the material, thereby generating aerosol. A smoker puffs the aerosol. As the heat source, a carbonaceous heat source is exclusively used.

A carbonaceous heat source composition is kneaded and then extruded into a rod shape to mold the carbonaceous heat source. Subsequently, the carbonaceous heat source is covered with heat resistant member made of an elastic jacket of glass fibers, for example, on its outer periphery, and then wrapped with an overlapping paper around the heat resistant member. Subsequently, the carbonaceous heat source rod is cut into a predetermined size, and further, the cut rod is cut into pieces for heat sources for individual smoking articles. In each of the carbonaceous heat sources, through-holes are formed in the axial direction thereof, the holes being made to function as an air passage when the aerosol generating section is heated with the carbonaceous heat source and exhibit initial combustion characteristics. The carbonaceous heat source composition contains water in a relatively high content of 20 to 40 wt % so as to be extruded. Some degree of water content is also required in order to cut the rod-shaped carbonaceous heat source in the predetermined size neatly without collapsing the through-holes. However, excessively high water content of the carbonaceous heat source causes problems such as deformation of the carbonaceous heat source, transfer of water to the elastic jacket and the overlapping paper covering the carbonaceous heat source, and decline in the ignitability of the carbonaceous heat source. It is therefore necessary to dry the carbonaceous heat source before the article is manufactured.

The method for drying the carbonaceous heat source includes, for example, hot-air drying or a method using microwave as described in Jpn. Pat. Appln. KOKAI Publication No. 8-332067. These methods, however, have a problem that the aerosol generating section is also heated at the same time when the carbonaceous heat source is heated to be dried. When the aerosol generating section is heated, the aerosol generating material contained therein is degraded in quality to result in a problem that flavor are taste are impaired.

BRIEF SUMMARY OF THE INVENTION

Accordingly, an object of the invention is to provide a method for selectively drying a carbonaceous heat source without heating an aerosol generating section. Another object of the invention is to provide an apparatus used for drying the carbonaceous heat source.

According to an aspect of the invention, there is provided a method for drying a molded product for a non-combustible smoking article, comprising: preparing a molded product for a non-combustible smoking article corresponding to two non-combustible smoking articles comprising an aerosol generating section which generates aerosol when heated and carbonaceous heat sources fitted to both ends of the aerosol generating section; covering the aerosol generating section with a far infrared reflective cover; and irradiating the carbonaceous heat sources with far infrared radiation from a far infrared heater.

According to another aspect of the invention, there is provided a drying apparatus for a molded product for a non-combustible smoking article, comprising: a support supporting a molded product for a non-combustible smoking article corresponding to two non-combustible smoking articles comprising an aerosol generating section which generates aerosol when heated and carbonaceous heat sources fitted to both ends of the aerosol generating section in a state that the aerosol generating section is covered with a far infrared reflective cover; and a far-infrared heater arranged to irradiate the carbonaceous heat sources with far infrared radiation.

DETAILED DESCRIPTION OF THE INVENTION

The present invention will be described in detail hereinafter.

Figure 1:
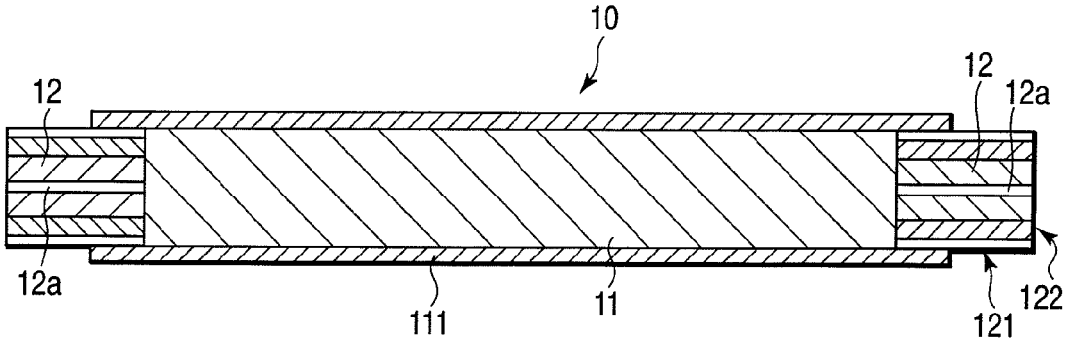
FIG. 1 is a cross-sectional view of a molded product for non-combustible smoking article to be treated by a method of the invention.

FIG. 1 shows an example of a molded product for a non-combustible smoking article to be treated by a method of the present invention. The molded product 10 for non-combustible smoking article comprises an aerosol generating section and carbonaceous heat sources fitted to both ends of the aerosol generating section. The aerosol generating section has a structure that an aerosol generating member 11, which generates aerosol when heated, is held in a cylindrical body 111. Each carbonaceous heat source 12 is covered with heat resistant member 122 made of an elastic jacket of glass fibers, for example, on its outer periphery, and then wrapped with an overlapping paper 121 around the heat resistant member 122 into a cylindrical shape. The carbonaceous heat source 12 generally has through-holes 12*a* in the axis direction thereof, through which the outside air is taken in.

Cutting the molded product 10 for the non-combustible smoking article at the center provides main parts of two non-combustible smoking articles. A non-combustible smoking article can be produced by fitting a flavor generating section and a filter, if desired, to the end of the aerosol generating section of the resultant main part for the non-combustible smoking article.

An aerosol generating material contained in the aerosol generating section includes, for example, a polyhydric alcohol such as glycerin, propylene glycol, triethylene glycol and tetraethylene glycol, and an aliphatic ester of a carboxylic acid, such as methyl stearate, dimethyl dodecanedioate or dimethyl tetradecanedioate. The aerosol generating material is usually carried on an appropriate carrier. The carrier includes a porous material such as paper or activated charcoal. The aerosol generating material is absorbed or adsorbed onto the porous material, thereby preparing the aerosol generating member. Alternatively, the carrier may be a glucan gel, such as curdlan, disclosed in Japanese Patent No. 3118462. Specifically, the aerosol generating material is added to an aqueous dispersion of thermally irreversible coagulable glucan, the resultant dispersion is cast into a thin sheet on a belt of stainless steel, for example, and then the sheet is heated and dried to turn the glucan into a gel. The glucan gel which contains the aerosol generating material is cut or pulverized, which can be used as the aerosol generating material.

The aerosol generating member that the aerosol generating material is carried on the carrier is contained in the cylindrical body 111, which is made of a non-combustible material such as a paper sheet containing glass fiber or a paper sheet lined with a ceramic material or metal foil, whereby the aerosol generating section can be formed.

The carbonaceous heat source composition for the carbonaceous heat source 12 usually contains carbon, calcium carbonate, a binder and a polyhydric alcohol. The amount of (granular) calcium carbonate in the carbonaceous heat source composition preferably ranges from 30 to 55% by weight. The binder is contained to bind calcium carbonate and carbon to each other. The amount of the binder preferably ranges from 5 to 15% by weight. The binder includes an alginic acid salt, carboxymethylcellulose or a salt thereof, pectin or a salt thereof, carrageenan or a salt thereof, guar gum, and the like. The polyhydric alcohol is preferably contained in an amount of 0.5 to 5% by weight. The polyhydric alcohol includes glycerin, propylene glycol and the like. The balance of the carbonaceous heat source composition other than the above components is carbon. The origin of the carbon (particles) used is not particularly limited, and well known carbon may be used.

Usually, molded products for non-combustible smoking article as described above are arrayed and stacked one another, if desired, and the outer circumferences of the aerosol generating sections are covered with a far infrared reflective cover. The material of the far infrared reflective cover is not particularly limited, and may be a metal foil or metal plate which sufficiently reflects far infrared radiation, such as an aluminum foil. When covered with the cover, the aerosol generating sections are not irradiated with far infrared radiation, so that the aerosol generating members can be prevented from being heated.

For the same reason, a material having a metallic surface which reflects far infrared radiation is preferably used for a support for supporting the molded products for non-combustible smoking article.

A far infrared heater configured to irradiate the carbonaceous heat sources with far infrared radiation may be any type of far infrared heater. The temperature of the far infrared heater is preferably set to the range of 200 to 600° C. If the temperature of the far infrared heater is lower than 200° C., a long time is required for sufficiently drying the carbonaceous heat sources. If the temperature of the far infrared heater is higher than 600° C., the time can be shortened but a member or structure for supporting the heater is required to be made of a highly heat-resistant material, which brings about increase in cost. The irradiation time with far infrared radiation for the carbonaceous heat sources preferably ranges from 5 seconds to 5 minutes. If the irradiation time is less than 5 seconds, it is difficult to sufficiently dry the carbonaceous heat sources. It is sufficient that the irradiation time is 5 minutes, which is regarded as the upper limit. For lowering the water content of the carbonaceous heat sources in a range of 9 to 10 wt % in generally, the temperature of the far infrared heater and the irradiation time of far infrared radiation are relevant to each other. When the temperature of the far infrared heater is set to about 600° C., for example, the irradiation time is set to about 5 seconds. When the temperature of the far infrared heater is set to about 200° C., the irradiation time is set to about 5 minutes.

When the carbonaceous heat sources are irradiated with far infrared radiation, it is preferable to cause a gas to blow between the far infrared heater and the carbonaceous heat sources of the molded products for non-combustible smoking article. Since water vapor in the air absorbs far infrared radiation, the temperature of the atmosphere may be raised so that the aerosol generation sections may be warmed. In order to avoid this phenomenon, a gas is caused to blow between the far infrared heater and the carbonaceous heat sources so that the warmed air (water vapor) is discharged. A means for causing the gas to blow is not particularly limited. Since the warmed air moves upward, it is preferable to cause the gas to blow from the lower side to the upper side of the apparatus. It is also expected that the gas blow brings about an effect of cooling the support for supporting the article molded for non-combustible smoking products and other members. Cooling of the support and other members makes it possible to suppress heat conduction to the aerosol generating sections.

Next, specific examples of the method and the apparatus for drying molded products for non-combustible smoking article according to the invention will be described with reference to the drawings.

Figure 2A:
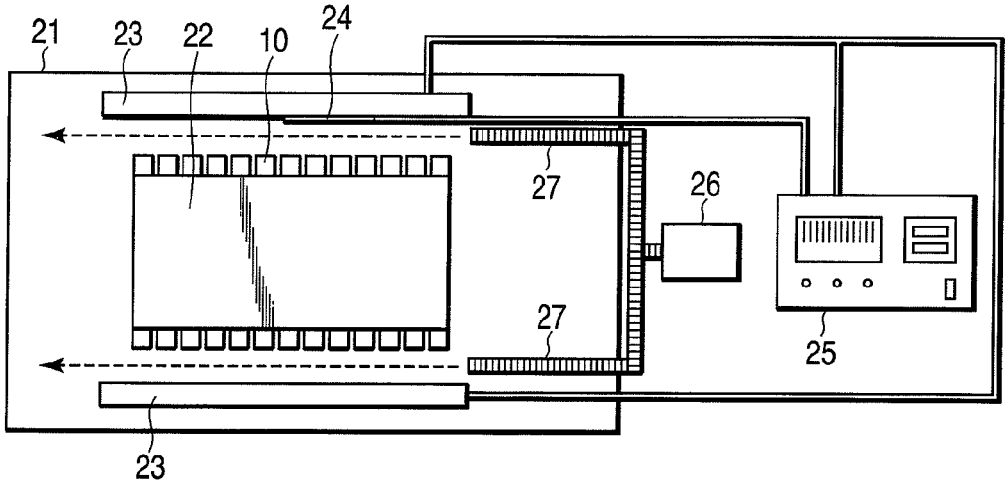
FIG. 2A is a plan view showing a method and an apparatus for drying molded products for non-combustible smoking article.
Figure 2B:
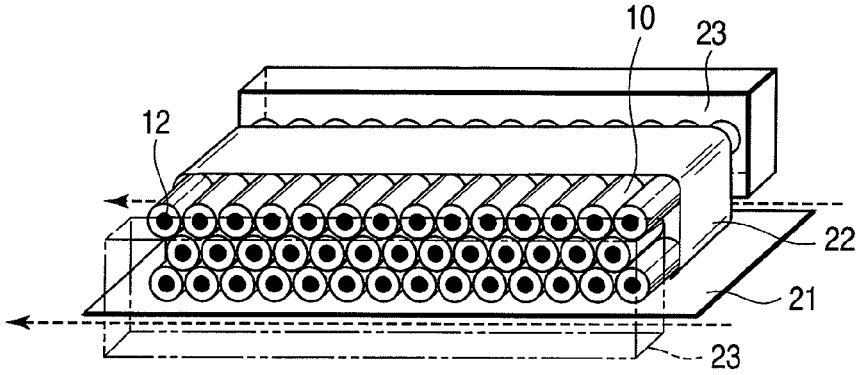
FIG. 2B is a perspective view showing a method and an apparatus for drying molded products for non-combustible smoking article.

FIG. 2A is a plan view showing a method and an apparatus for drying molded products for non-combustible smoking article according to an embodiment of the invention, and FIG. 2B is a perspective view thereof. A tray 21 made of a SUS plate is used as a support, on which the molded products 10 for non-combustible smoking article as shown in FIG. 1 are supported in such a manner that they are arrayed in a row and stacked one after another to form three tiers, for example. The number of the tiers of the molded products 10 for stacked non-combustible smoking article is not particularly limited, and may be appropriately adjusted. The outer circumferences of aerosol generating sections 11 (depicted in FIG. 1) of the stacked molded products 10 for non-combustible smoking article are covered with a far infrared reflective aluminum foil 22. A pair of far infrared heaters 23, 23 are arranged to be opposed to exposed carbonaceous heat sources 12 on both sides of the stack of the molded products 10 for non-combustible smoking article.

The distance between the end surface of the stack of the molded products 10 for non-combustible smoking article and the corresponding far infrared heater 23 may be arbitrarily set to a range of 10 to 150 mm. A thermocouple 24 is arranged near one of the far infrared heaters 23. The far infrared heaters 23, 23 and the thermocouple 24 are connected to and controlled by a controller 25. Air is caused to blow in the horizontal direction from a container 26 containing compressed air through pipes 27 in between the stack of the molded products 10 for non-combustible smoking article and the far infrared heaters 23, 23.

Figure 3A:
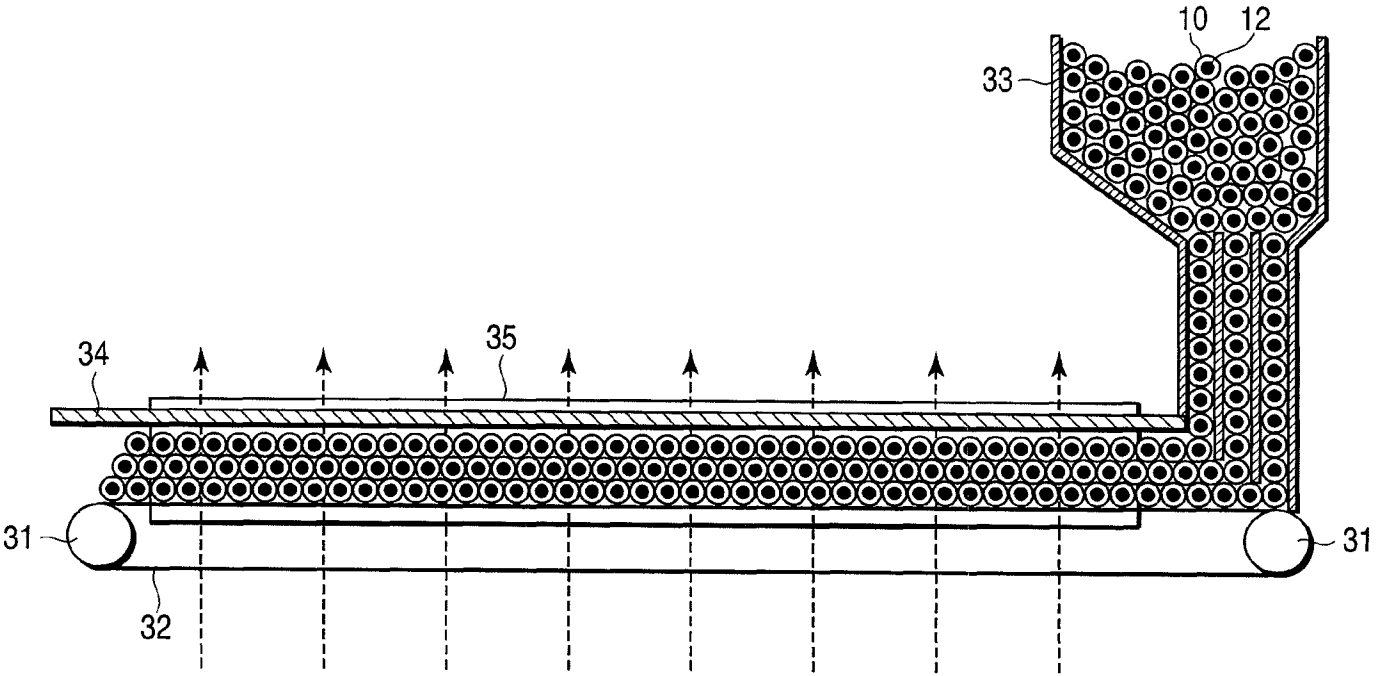
FIG. 3A is a cross-sectional view showing a method and an apparatus for drying molded products for non-combustible smoking article.
Figure 3B:
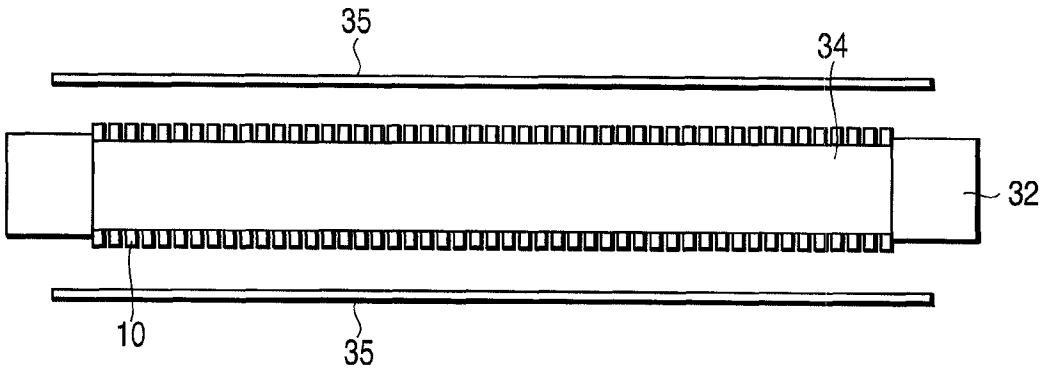
FIG. 3B is a plan view showing a method and an apparatus for drying molded products for non-combustible smoking article.

FIG. 3A is a cross-sectional view showing a method and an apparatus for drying molded products for non-combustible smoking article according to another embodiment of the invention, and FIG. 3B is a plan view thereof. Rollers 31, 31 are located at the lower region of the apparatus, and a metal belt 32 with a glossy surface is looped around each of the rollers 31, 31. The metal belt 32 is used as a support. A buffer 33 to store molded products 10 for non-combustible smoking article is located at the upper region of the apparatus. The molded products 10 for non-combustible smoking article supplied from the buffer 33 are supported on the metal belt 32 in such a manner that they are arrayed in a row on the metal belt 32 and stacked one after another to form three tiers, for example, to be conveyed with the metal belt 32. A metal plate 34 with a glossy surface which reflects far infrared radiation is arranged to cover aerosol generating sections 11 (depicted in FIG. 1) of the molded products 10 for non-combustible smoking article. A pair of far infrared heaters 35, 35 are arranged to be opposed to exposed carbonaceous heat sources 12 on both sides of the stack of the molded products 10 for non-combustible smoking article. The distance between the end surface of the stack of the molded products 10 for non-combustible smoking article and the corresponding far infrared heater 35 may be arbitrarily set to a range of 10 to 150 mm. A temperature sensor (not shown) such as a thermocouple is arranged near the far infrared heater 35. The far infrared heaters 35, and the temperature sensor are connected to and controlled by a controller (not shown). Air is caused to blow upward in the vertical direction from a container (not shown) containing compressed air through pipes (not shown) in between the stack of the molded products 10 for non-combustible smoking article and the far infrared heaters 35, 35.

The use of the drying methods and the drying apparatuses as described above makes it possible to prevent the aerosol generating section 11 from being heated by covering the aerosol generating section 11 shown in FIG. 1 with a far infrared reflective cover so as to reflect far infrared radiation as well as to dry the carbonaceous heat sources 12 by causing far infrared radiation to be selectively absorbed by the carbonaceous heat sources 12.

As shown in FIGS. 2A and 2B, the carbonaceous heat sources may be dried in the state that the stack of the molded products 10 for non-combustible smoking article is stood still. As shown in FIGS. 3A and 3B, the carbonaceous heat sources may be dried while the stack of the molded products 10 for non-combustible smoking article is conveyed.

EXAMPLES

The present invention will be described by way of Examples hereinafter; however, the invention is not limited thereto.

The method and the apparatus shown in FIGS. 2A and 2B were used to dry the carbonaceous heat sources of the molded products 10 for non-combustible smoking article. The distance between one end surface of the stack of the molded products 10 for non-combustible smoking article and the corresponding far infrared heater 23 was set to 10 mm. The far infrared heaters 23 used were PH-150 manufactured by SAKAGUCHI E. H VOC Corp. The specifications of the far infrared heaters 23 were as follows; the voltage of 100 V and the power of 1 kW. The thermocouple 24 was a K-type thermocouple with a sheath diameter of 1.0 mm and a sheath length of 200 mm. The controller 25 used was a box type control unit SSR-S20-P manufactured by SAKAGUCHI E. H VOC Corp.

Example 1

A composition prepared by kneading carbon, calcium carbonate, a binder (ammonium alginate) and a polyhydric alcohol (glycerin) in a weight percent ratio of 50:40:8:2 was extruded with a extruder at room temperature (24° C.) to produce carbonaceous heat sources 12. The water content the extruded carbonaceous heat sources was about 25 wt %. The carbonaceous heat sources 12 were used to produce a molded product 10 for non-combustible smoking article having the structure shown in FIG. 1.

The aerosol generating member 11 was prepared by mixing followings: (i) a material prepared by mixing an aerosol generating material of glycerin, tobacco stem pulp, tobacco powder and a binder; casting the mixture into a sheet; and cutting the sheet, and (ii) cut tobacco. The mixing ratio of (i) to (ii) was 1:1.

The molded products for non-combustible smoking article were placed on the tray 21 shown in FIGS. 2A and 2B, and the aerosol generating sections were covered with the aluminum foil 22. While a gas was caused to blow as shown in the figures, the carbonaceous heat sources were irradiated with far infrared radiation thereon at 250° C. for 4 minutes using the far infrared heaters 23 so as to be dried. The surface temperature of the molded products at this time is reported in Table 1. After irradiation with far infrared radiation, the molded products for non-combustible smoking article were conditioned. The conditioning is an operation that the molded product for non-combustible smoking article is stored until the water content thereof reaches an equilibrium state.

The water contents of the carbonaceous heat source and of the aerosol generating section, at each of times immediately after manufacture, immediately after irradiation with far infrared radiation, and after conditioning are reported in Table 2.

Comparative Example 1

The molded products for non-combustible smoking article manufactured in the same way as in Example 1 were put into a hot-air dryer and dried with hot air of 70° C. for 10 minutes. The surface temperature of the molded products at this time is also reported in Table 1. The dried molded products for non-combustible smoking article were conditioned as described above. The water contents of the carbonaceous heat source and of the aerosol generating section, at each of times immediately after manufacture, after hot-air drying, and after conditioning are also reported in Table 2.

Comparative Example 2

The molded products for non-combustible smoking article manufactured in the same way as in Example 1 were placed on a tray, and then passed continuously between two microwave drying systems with a power of 2 kW so as to be dried. The time required for passing the systems was set to 3 minutes. The surface temperature of the molded products at this time is also reported in Table 1. The dried molded products for non-combustible smoking article were conditioned as described above. The water contents of the carbonaceous heat source and of the aerosol generating section at each of times immediately after manufacture, after drying, and after conditioning are also reported in Table 2.

TABLE 1

Surface temperature of molded product for non-combustible smoking article

| | Drying conditions | Surface temperature of molded product (° C.) |
|---|---|---|
| Example 1 | far-infrared heater 250° C., 4 minutes | 27.1 |
| Comparative Example 1 | hot-air drying 70° C., 10 minutes | 43.5 |
| Comparative Example 2 | microwave drying 2 kW (two driers), 3 minutes | 37.1 |

TABLE 2

Water contents of carbonaceous heat source and aerosol generating section (wt %)

| Drying conditions | | Immediately after manufacture of smoking article | After drying | After conditioning |
|---|---|---|---|---|
| Example 1 | carbonaceous heat source | 13.91 | 8.91 | 7.34 |
| | aerosol generating section | 14.71 | 14.03 | 16.12 |
| Comparative Example 1 | carbonaceous heat source | 13.91 | 8.98 | 7.33 |
| | aerosol generating section | 14.71 | 13.88 | 16.55 |
| Comparative Example 2 | carbonaceous heat source | 13.91 | 8.87 | 7.56 |
| | aerosol generating section | 14.71 | 13.47 | 16.01 |

Examples 2 to 5

The molded products for non-combustible smoking article were manufactured in the same way as in Example 1, and then irradiated with far infrared radiation under the conditions of far infrared heater temperature and time reported in Table 3. After irradiation with far infrared radiation, the smoking articles were conditioned.

After the conditioning, the resultant molded products for non-combustible smoking article were cut at the center thereof. A flavor generating section and a filter were fitted to the rear end of the aerosol generating section to manufacture a non-combustible smoking article. Cut tobacco added with various aroma materials was used for the flavor generating section. A general filter made of acetate fibers was used for the filter. The thus obtained non-combustible smoking article was evaluated for the taste. The evaluation scores and the evaluation judgments are reported in Table 3.

Comparative Example 3

The molded products for non-combustible smoking article were manufactured in the same way as in Example 1, and dried and conditioned under the same conditions as in Comparative Example 1, and then non-combustible smoking article was manufactured in the same way as in Examples 2 to 5. The thus obtained non-combustible smoking article was evaluated for the taste. The evaluation scores and the evaluation judgments are also reported in Table 3.

Comparative Example 4

The molded products for non-combustible smoking article were manufactured in the same way as in Example 1, and dried and conditioned under the same conditions as in Comparative Example 2, and then non-combustible smoking article was manufactured in the same way as in Examples 2 to 5. The thus obtained non-combustible smoking article was evaluated for the taste. The evaluation scores and the evaluation judgments are also reported in Table 3.

TABLE 3

| | | score* | Evaluation Judgment |
|---|---|---|---|
| Example 2 | Heater surface temperature: 400° C. Drying time: 1 min | 4 | Thermal damage to cut tobacco can be avoided. Astringency and unpleasant taste are decreased, and lightness and brightness are generated in flavor quality. |
| Example 3 | Heater surface temperature: 300° C. Drying time: 4 min | 4 | Similar to the above. |
| Example 4 | Heater surface temperature: 250° C. Drying time: 3 min | 5 | Similar to the above. Further, taste balance is best matched. |
| Example 5 | Heater surface temperature: 200° C. Drying time: 7 min | 4 | Similar to Examples 2 and 3. |
| Comparative Example 3 | Hot air temperature: 70° C. Drying time: 10 min | 1 | Cut tobacco is thermally damaged by hot air. Greenness and astringency are somewhat involved. |
| Comparative Example 4 | Microwave power: 4 kW (Total) Drying time: 3 min | 2 | The carbonaceous heat sources are heated, but an effect of thermal damage to cut tobacco cannot be avoided. Astringency is somewhat involved. |

*The full marks of the evaluation scores are 5.

As described in detail above, according to the invention, the use of far infrared radiation makes it possible to selectively dry the carbonaceous heat sources without heating the aerosol generating section. Thus, the finally produced non-combustible smoking article is not damaged in flavor and taste.

What is claimed is:

1. A method for drying a molded product for a non-combustible smoking article, comprising:

preparing a molded product for a non-combustible smoking article comprising an aerosol generating section which generates aerosol when heated and extruded carbonaceous heat sources fitted to both ends of the aerosol generating section;

covering the aerosol generating section with a far infrared reflective cover; and then irradiating the extruded carbonaceous heat sources with far infrared radiation from a far infrared heater to dry the extruded carbonaceous heat sources.

2. The method according to claim 1, wherein a temperature of the far infrared heater ranges from 200 to 600° C.

3. The method according to claim 1, wherein an irradiation time for carbonaceous heat sources with far infrared radiation ranges from 5 seconds to 5 minutes.

4. The method according to claim 1, wherein the carbonaceous heat sources are irradiated with far infrared radiation while a gas is caused to blow between the far infrared heater and the carbonaceous heat sources of the molded product for the non-combustible smoking article.

* * * * *